United States Patent [19]

Deitz

[11] 4,295,235

[45] Oct. 20, 1981

[54] WATERPROOF CUSHION FOR OUTDOOR USE AND METHOD FOR MANUFACTURING THE SAME

[75] Inventor: Bernard Deitz, West Orange, N.J.

[73] Assignee: Deitz Plastic Formers, Prospect Park, N.J.

[21] Appl. No.: 115,871

[22] Filed: Jan. 28, 1980

[51] Int. Cl.[3] ..... A47C 27/14; A47G 9/00

[52] U.S. Cl. ..... 5/473; 5/490; 156/92; 156/308.4

[58] Field of Search ..... 5/417, 420, 448, 431, 5/432, 434, 435, 436, 442, 490, 473; 156/92, 308.4

[56] References Cited

U.S. PATENT DOCUMENTS

| | | | |
|---|---|---|---|
| 2,620,494 | 12/1952 | Kay | 5/473 |
| 2,660,735 | 12/1953 | Baum | 5/473 |
| 3,042,938 | 7/1962 | Lawson | 5/435 |
| 3,058,124 | 10/1962 | Sturtevant | 5/473 |
| 3,109,182 | 11/1963 | Doak | 5/334 |

FOREIGN PATENT DOCUMENTS

| | | | |
|---|---|---|---|
| 1344036 | 1/1974 | United Kingdom | 5/434 |

*Primary Examiner*—Roy D. Frazier
*Assistant Examiner*—Alexander Grosz
*Attorney, Agent, or Firm*—Steinberg & Raskin

[57] ABSTRACT

A cushion adapted for outdoor use in connection with outdoor furniture or the like including a pair of opposed woven fabric side layers, preferably formed of loosely woven plastic coated filaments, and an interlayer formed of a water impervious material disposed between the side layers, the side layers and interlayer being mutually attached, preferably by heat sealing, along their respective peripherally extending edge regions so as to define a pair of adjacent isolated chambers separated by the interlayer. A filler material is located entirely in one of the chambers such that the interlayer is contiguous with the inner surface of one of the side layers and spaced from the inner surface of the other of the side layers. The outer surface of at least one of the side layers will remain dry or be easily dryable even after either one of the side layers of the cushion is exposed to wet weather conditions.

7 Claims, 9 Drawing Figures

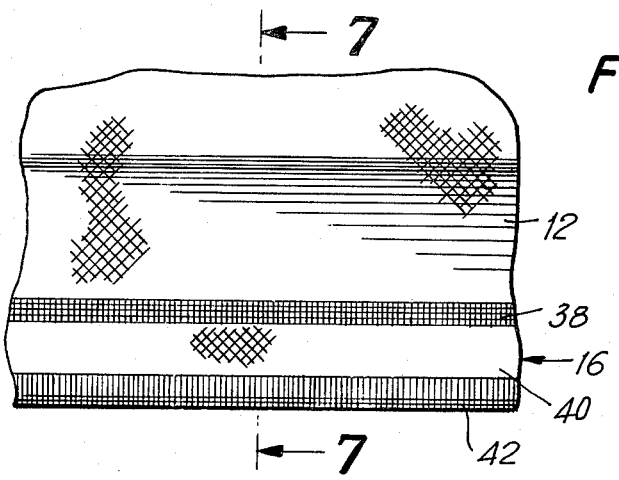
FIG. 5
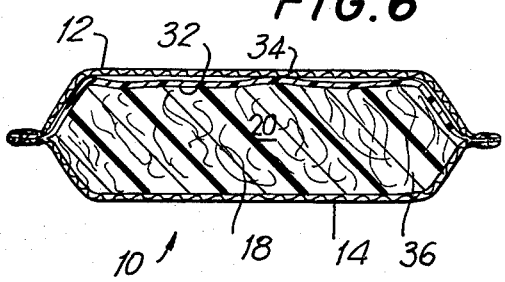
FIG. 6
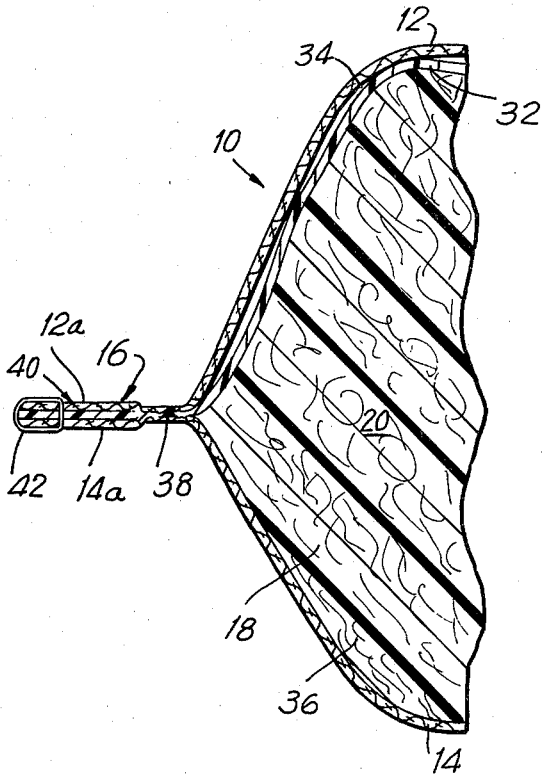
FIG. 7
FIG. 8
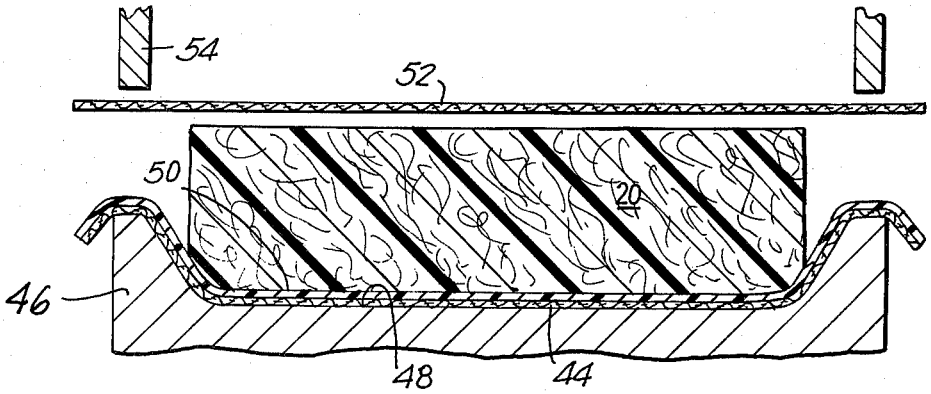

WATERPROOF CUSHION FOR OUTDOOR USE AND METHOD FOR MANUFACTURING THE SAME

BACKGROUND OF THE INVENTION

This invention relates generally to seating cushions and, more particularly, to waterproof cushions, i.e., cushions whose side layer outer surfaces and, preferably, the filler material thereof, remain dry or easily dryable after exposure to wet weather conditions, and a method for manufacturing the same.

Seating cushions adapted for outdoor use, namely in conjunction with outdoor furniture such as chairs and lounges, are well known. A design criteria of such cushions is that such should be usable, i.e., can be sat upon, substantially soon after the cushions are exposed to wet weather conditions, such as a rainstorm or the like.

Several attempts have been made to design a cushion for outdoor use which satisfies this design criteria. More particularly, one such outdoor cushion is constructed of side layers formed of continuous vinyl sheets attached along their respective peripheral edge regions to define an interior space therebetween in which a filler material, such as shredded polyurethane foam, is located. However due to the air impervious nature of the side layers formed of vinyl sheets, it is necessary to provide openings therethrough in the form of pin holes or the like to prevent the interior space from being air tight and, therefore, to allow the filler material itself to determine the "cushioning" or seating characteristics of the cushion. However, although the vinyl sheet is easily wiped dry after being exposed to wet weather conditions, the provision of openings in the vinyl sheets as discussed above unavoidably allows water to enter into the interior space between them whereupon the filler material becomes wet. Since the vinyl sheets are substantially air impervious (except for the small area thereof provided with openings as described above), a free conduction of air through the interior space is prevented thereby making it difficult if not impossible for the wet filler material to become dry through evaporation in a suitably short time to allow the cushion to be used a reasonable time after improvement of the weather conditions. Thus, if the filler material should become wet, the same tends to remain wet or at least damp for a relatively long period of time thereby not only rendering the cushion impracticle or at least uncomfortable for use but, additionally, presents the possibility that the filler material itself will mildew, the latter tending to occur when the filler material is subjected to continuous cycles of being wet and then dried.

In order to increase the speed with which the filler material would dry after becoming wet, outdoor cushions have been constructed of side layers which, rather than being formed of vinyl sheet material, comprise woven fabric material constructed of vinyl covered nylon or polyester thread. Such woven fabric material generally has a relatively loose or open weave so that relatively large spaces are defined between the filaments of the woven fabric. One type of such plastic coated thread is available under the name Textilene from Twitchell Corp. of Dotham, North Carolina while one type of such fabric is available under the name Textalure from Engineered Yarns, Inc. of Coventry, R.I.

Although the use of such air pervious fabric has resulted in significant improvements in the circulation of air throughout the cushion interior space to thereby facilitate drying of the filler material after the same becomes wet, cushions constructed of such material present other problems. More particularly, when shredded polyurethane foam is utilized as a filler material in such cushions, pieces of the same tend to conglomerate upon becoming wet with the resulting conglomerates tending to fall through the relatively large spaces of the woven fabric which, of course, is quite undesirable. In order to obviate this problem, such filler material has been disposed within a perforated nonwoven roving or bag. However, this provision again resulted in a prolongation of the drying time for the filler material due to the non-woven roving inhibiting air circulation through the cushion interior. Further, water present in the filler material prior to it becoming dry would tend to rewet the outer surface of the side layers upon the cushion being sat upon.

Other attempts to overcome the above discussed problems have focussed on the nature of the filler material itself. Thus, the filler material has been made from polyurethane foam in slab form. Although such provision has overcome the problem of shredded filler material tending to conglomerate and fall through the spaces in the woven fabric side layers, the slab foam filler material still requires a relatively long time to dry after becoming wet thereby increasing the chances of mildew. The latter problem is especially acute when the woven fabric of the side layers comprises a relatively loose or open weave which permits ultraviolet rays to pass through the fabric spaces which accelerates the mildewing action. Other disadvantages inherent in the use per se of foam as a filler material, namely, inability to wash the same due to consequent deterioration thereof, of course remain.

It is understood that the problems discussed above are present in various degrees depending upon the particular geographical locale in which the cushion is used. Thus, the filler material in cushions used in, for example, the Southern part of the United States, e.g., Florida, tend to dry faster than in other locations due to the particular weather conditions which prevail. However, the problems still exist to some extent even in such areas and, further, are equally serious in cases where the cushions are of the type that have buttons or like elements fastened to the slab foam material through the side layers in order to fix the filler material in place since air circulation is again obstructed thereby prolonging drying of the filler material.

Still other materials are utilized as a filler material which are chosen so as to promote increased drying rates. Thus, polyester material has found increasing use as a filler for outdoor cushions. Although such material does indeed tend to dry faster than polyurethane foam material, polyester is between 2 and 2½ times as expensive as equivalent amounts of polyurethane and the wetness problem although not as severe as it has been in the case of polyurethane foam, still persists. Further, the seating characteristics of Dacron material are generally considered as not being as good as those of polyurethane foam.

From the above, it is seen that conventional outdoor cushions which are presently available are not entirely satisfactory for the reasons that firstly, the filler material tends to become wet when exposed to wet weather conditions thereby rendering the cushion unusable and possibly damaging the same and, secondly, when wet, an undesirably long period of time is required for the filler material to dry thereby rendering the cushion unusable for that time and possibly subjecting the cushion filler material to a mildewing action. Attempts to overcome these problems have not been entirely successful and have often resulted in cushions which are unduly expensive in manufacture.

SUMMARY OF THE INVENTION

Accordingly, one object of the present invention is to provide a new and improved cushion for outdoor use.

Another object of the present invention is to provide a new and improved outdoor cushion whose side layers are made from a plastic coated woven fabric material of open weave and a filler material located therebetween and which is constructed so that the filler material will not be wet during exposure of the cushion to wet weather conditions.

Still another object of the present invention is to provide a new and improved outdoor cushion wherein the outer surfaces of the side layers thereof are easily dried after exposure to wet weather conditions.

A further object of the present invention is to provide a new and improved waterproof outdoor cushion which is simple and inexpensive in manufacture.

Briefly, in accordance with the present invention, these and other objects are attained by providing a cushion constructed of a pair of side layers formed of fabric material, which fabric material is itself constructed of filaments of plastic coated threads, which side layers are attached along their peripherally extending edge regions to define an interior space therebetween and a filler material located substantially throughout the interior space. According to the invention, a thin interlayer formed of water impervious material, such as vinyl, is attached along its peripherally extending edge region to the pair of opposed side layers along their respective peripherally extending edge regions. The interlayer extends entirely through the interior space to divide the same into a pair of adjacent isolated chambers which are separated by the interlayer. The filler material is located entirely within one of the two chambers in a manner such that the interlayer is contiguous with the inner surface of one of the side layers and spaced from the inner surface of the other one of the side layers by the filler material.

In the preferred embodiment of the invention, the peripherally extending edge regions of the side layers and interlayer are attached by the application of heat to the edge regions of the side layer which fuses the plastic coating of the woven fabric of the respective side layers as well as the edge regions of the interlayer to each other to form a heat seal band which extends around the entire periphery of the cushion. Coextensive portions of the edge regions of the side layers and interlayer preferably extend outwardly to some extent beyond the heat seal band and are mechanically fixed to each other, such as by sewing.

In manufacturing the cushion of the present invention, a first sheet formed of woven fabric comprising plastic coated thread is located in an appropriately formed heat sealing die whereupon a sheet or self-supporting film of water impervious material is located thereover. The filler material, which may comprise any conventional material such, for example, as a polyurethane foam or polyester fiber batting, is located over the water impervious film or sheet whereupon a second woven fabric sheet is located over the filler material. A heated member is actuated to bear against the peripherally extending edge region of the woven fabric and intermediate sheet or film to form a peripherally extending heat seal band and in a manner such that the filler material is located entirely between the first woven fabric sheet and the water impervious film. The edges of the article thus formed outwardly of the heat seal band are appropriately trimmed and sewed together.

In operation, the cushion is placed on a piece of outdoor furniture with the first side layer, i.e., the side layer to which the water impervious interlayer is contiguous, facing upwardly. In this manner, water which contacts the upwardly facing side layer, such as during a rainstorm, is prevented from wetting the filler material by the water impervious interlayer so that most water which impinges on the cushion will flow by gravity over the outer surface of the upwardly facing side layer onto the peripheral edge region thereof from where it either drips by itself or can be easily wiped. Any water which passes through the side layer through the spaces between the filaments thereof will be contained within the chamber defined between the interlayer and the upwardly facing side layer. Upon the application of a light wiping pressure, such water is forced back through the spaces in the side layer so that it, together with the water which remains on the upper surface of the side layer, can be easily removed.

An additional advantage of the present invention is that even if the cushion is incorrectly placed on the furniture so that the side layer which is intended to face downwardly in fact faces upwardly, the cushion still can be utilized substantially immediately after the cushion is wet. Thus, in such circumstance, it is only necessary to invert the cushion so that the side layer which faced downwardly now faces upwardly. Since this initially downwardly facing side layer will have remained dry during the adverse weather conditions, the cushion can be used immediately. Of course, the filler material will have become wet by virtue of water passing through the woven fabric of the initially upwardly facing side layer. However, the moisture contained in the filler material cannot be transferred to the initially downwardly facing side layer by virtue of the presence of the interlayer. The filler material will dry in a rapid fashion due to the fact that circulation of air therethrough through the initially upwardly facing side layer is relatively free and unobstructed. Further, the cushion can be compressed thereby compressing the filler material to force most of the water therefrom and during such operation, the water impervious interlayer acts both to prevent water from the filler material from wetting the initially downwardly facing side layer and, additionally, acts to force the water within the filler material out through the spaces in the side layer which initially faced upwardly.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which:

FIG. 5 is a detail view of the area in FIG. 4 contained within the circle illustrating the structure of the peripheral side edge regions of the cushion;

FIG. 6 is a section view taken along line 6—6 of FIG. 3;

FIG. 7 is a section view taken along line 7—7 of FIG. 5; and

FIG. 8 is a schematic view illustrating the method of manufacturing a cushion according to the present invention.

DESCRIPTION OF THE PREFERRED EMBODIMENTS

Figure 1:
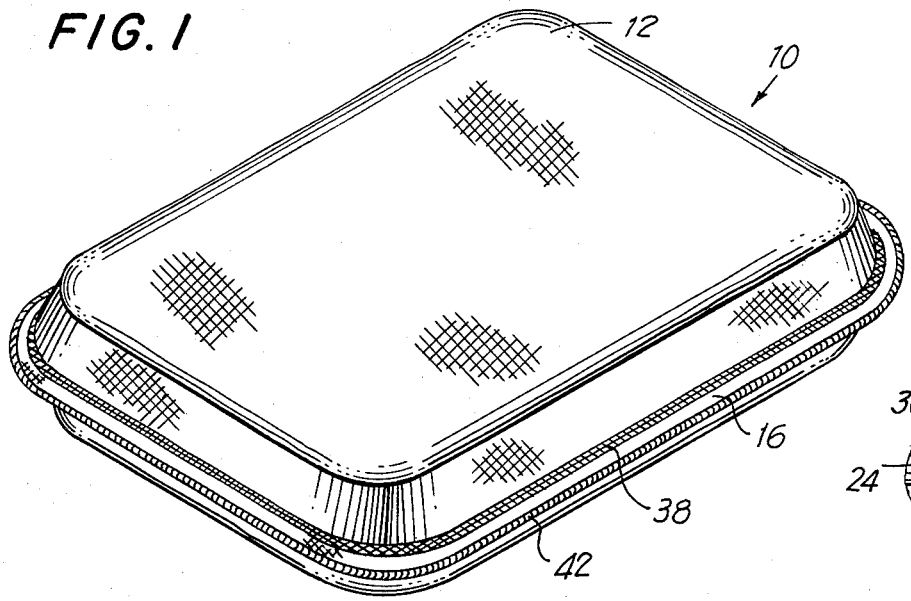
FIG. 1 is a perspective view of a cushion constructed according to the present invention.

Referring now to the drawings wherein like reference characters designate identical or corresponding parts throughout the several views, an outdoor cushion constructed according to the present invention is generally designated 10 and includes first and second side layers 12, 14, respectively, which are joined at their respective peripherally extending edge regions 12*a*, 14*a* (FIG. 7) to define a peripherally extending cushion edge region 16. The first and second side layers 12, 14 define an interior space 18 (FIGS. 6 and 7) between them in which a filler material 20 is located. The filler material can comprise any conventional material utilized for such purposes such, for example, as polyurethane foam in either shredded or slab form or polyester fiber batting, such as Dacron.

Figure 2:
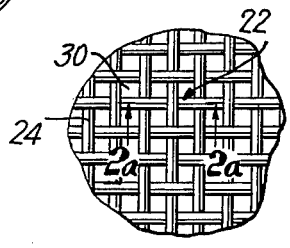
FIG. 2 is a detailed view illustrating the structure of the woven fabric material comprising the side layers of the cushion illustrated in FIG. 1.
Figure 2A:
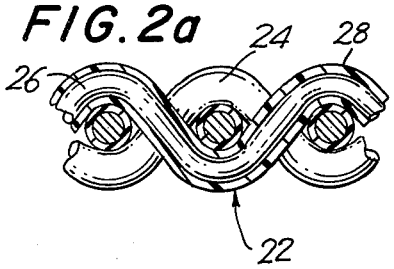
FIG. 2*a* is a section view taken along line 2*a*—2*a* of FIG. 2.
Figure 3:
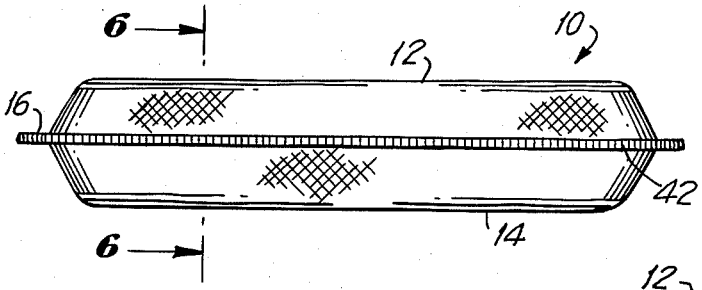
FIG. 3 is a side elevation view of the cushion illustrated in FIG. 1.
Figure 4:
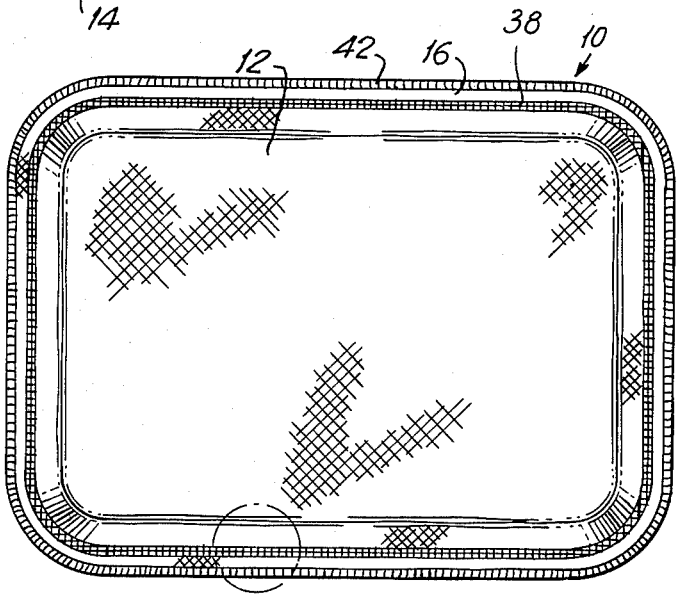
FIG. 4 is a top plan view of the cushion illustrated in FIG. 1.

Referring to FIGS. 2 and 2*a*, each side layer is formed of a woven fabric 22 composed of filaments 24 which themselves comprise nylon or polyester thread 26 or the like encapsulated within a vinyl coating 28. One type of such fabric is conventionally available under the trade name Textalure which is manufactured by Engineered Yarns Inc. of Coventry, R.I. One type of such filaments is conventionally available under the trade name Textilene, manufactured by Twitchell Corp. of Dothan, N.C. Such woven fabric material has a relatively loose or open weave so that spaces 30 (FIG. 2) are defined between the woven filaments 24.

Referring to FIGS. 6 and 7, a thin interlayer 32 formed of water impervious material is attached along its peripherally extending edge region to the edge regions of the opposed side layers 12, 14 so that the interlayer 32 extends entirely through the interior space 18 defined between the side layers to divide the same into a pair of adjacent isolated chambers 34, 36 which are separated from each other by the interlayer 32. Interlayer 32 preferably comprises a sheet or self-supporting film of vinyl material of about 2 gauge thickness. However, it is understood that any thin sheet material which is water impervious may be utilized as the interlayer and the same can have any suitable thickness.

The filler material 20 is located entirely in one of the chambers and in the illustrated embodiment is entirely located within chamber 36. In this manner, the interlayer 32 is contiguous with the inner surface of side layer 12 while it is spaced from the inner surface of the side layer 14 by the filler material 20.

The peripherally extending edge regions 12*a*, 14*a* of the first and second side layers 12, 14 and the peripherally extending edge region of the interlayer which is sandwiched between them are attached to each other by a heat seal which forms a seal band 38. More particularly, as described in greater detail hereinbelow in connection with the description of the method of construction of the cushion of the present invention, when a portion of the peripherally extending edge region of one of the side layers of the cushion is heated to a sufficient extent, the vinyl coating 28 of the filaments 24 of the woven fabric of both of the side layers as well as the adjacent vinyl material of the interlayer 32 melt and fuse together mutually attaching the pair of side layers and interposed interlayer together forming the seal band 38. In this manner, the chambers 34, 36 are effectively fluidly isolated from each other so that, for example, should any water enter into one of the chambers, it is not possible for the same to enter into the other one of the chambers by virtue of the presence of interlayer 32.

Referring to FIGS. 5 and 7, the peripherally extending edge regions 12*a*, 14*a* as well as the peripherally extending edge region of the interlayer extend outwardly beyond the seal band 38 to a certain extent so that the cushion edge region 16 comprises an inner seal band region 38 and an outer edge region 40 with the peripheral edges of the side layers and interlayer being substantially coextensive, i.e., being located one over the other. The outer edges of the side layers and interlayer are preferably sewn to each other such, for example, as by using a Merrow machine which forms continuous closed loops of thread around the edge of the cushion as designated 42 in the Figures. Such a provision has the dual effect of both "finishing" the cushion in an aesthetically pleasing manner, and, secondly, forming the edge region 16 of the cushion as a "trough" which will capture and dissipate any water which would fall from the outer surface of the side layer 12 during wet weather conditions. In this connection, it is possible to terminate the outward extent of the interlayer 32 at the seal band 38 of the cushion so that any water which falls into the trough like structure of the cushion edge region would be dissipated through the spaces in the woven fabric material comprising the side layers. However, this is not essential to the operation of the cushion of the invention.

In operation, the cushion 10 is located on a piece of outdoor furniture with the side layer which is spaced from the interlayer 32 by the filler material 20 facing downwardly or, in other words, with the side layer 12 which is contiguous with the interlayer 32 facing upwardly. It will be seen that should the cushion be thus exposed to wet weather conditions, such as a rainstorm or the like, any water which falls on the cushion 10 will impinge upon the upper side layer 12. Since the interlayer 32 is contiguous with the inner surface of side layer 12, substantially all of the water which impinges thereon will tend to flow under gravity to the trough-like edge region 16 of the cushion while the interlayer 32 prevents the water from wetting the filler material 20 which is located in an isolated manner in chamber 36. If any water should pass through the spaces between the filaments of the woven fabric comprising the side layer 12, the same will be contained in the isolated chamber 34 defined between the interlayer 32 and side layer 12 and will therefore similarly be prevented from wetting the filler material 20. Upon the weather conditions improving, the outer surface of side layer 12 can be easily wiped dry through the application of a light wiping pressure which not only wipes the water located on the outer surface of side layer 12 but, additionally, will tend to force any water which has entered the chamber 34 back through the spaces in the side layer 12 so that in this manner any water which may remain on the cushion 10 will be removed. It will be seen that in this manner, the filler material 20 remains dry at all times.

It should also be noted that the peripherally extending edge region 16 of cushion 10 acts to a certain extent as a shield which prevents water from contacting the downwardly facing side layer 14 of cushion 10 under severe wet weather conditions. Thus, referring to FIG. 7, the edge region 16 of cushion 10 extends outwardly beyond the side layer 14 so as to substantially obstruct the latter from any rain or the like which would otherwise impinge thereon.

Another important advantage is obtained by virtue of the structure of the cushion 10. More particularly, it is possible for the cushion 10 to be improperly placed on the furniture, i.e., with the side layer which is spaced from the interlayer 32 by the filler material 20 facing upwardly. In the illustrated embodiment, an improper positioning of the cushion 10 would result in the side layer 14 facing upwardly. Under such circumstances, water impinging on the side layer 14 would of course pass through the spaces defined between the filaments of the woven fabric and wet the filler material 20. In such case, however, it is still possible to utilize the cushion 10 immediately subsequent to the improvement of the wet weather conditions by merely inverting the cushion so that the side layer 14 faces downwardly. In such case, the side layer 12 will remain dry since the same is fluidly isolated from the wet filler material 20 by means of the interlayer 32. Further, if the cushion is compressed such as by being sat upon, the filler material 20 will be similarly compressed with the substantial portion of the water contained therein being squeezed therefrom through the spaces of the fabric comprising the side layer 14. Further, the filler material 20 will be quickly dried by virtue of the fact that a good circulation of air is provided through the filler material through the spaces of the woven fabric material comprising side layer 14.

Turning now to FIG. 8, a preferred method of manufacturing a cushion according to the present invention is illustrated. According to this method, sheets of woven fabric material of the type described above as well as a sheet or self-supporting film of water impervious material of the type described above are trimmed to dimensions somewhat greater than the final desired dimensions of the cushion. For example, for a cushion having final dimensions of 19 and ½ inches in width and 16 and ½ inches in length, the woven fabric sheets and water impervious sheet are trimmed to have dimensions of 22 inches by 22 inches. One of the woven fabric sheets, designated 44 intended to constitute the normally upwardly facing side layer 12 of the cushion is located in a heat seal die 46 provided with a suitably formed cavity 48. The thin sheet or self-supporting film of water impervious material 50 is then located over the woven fabric sheet 44 so that the edges thereof are substantially coextensive therewith. A suitable quantity of filler material 20 is then located over the water impervious sheet 50 within the cavity 48 and, finally, a second sheet 52 of woven fabric material which will constitute the normally downwardly facing side layer 14 of cushion 10 is located over the filler material as illustrated in FIG. 8. A heater member 54 is then displaced downwardly over the die 46 to contact the outer surface of the woven fabric sheet 52 whereupon the plastic coating of the filaments of the two fabric sheets as well as the vinyl material of the sheet of water impervious material 50 are fused together to form a heat seal. The assembly thus formed is removed from the die 46 and the peripheral edge region thereof trimmed to a desired extent either manually or by machine. Finally, the edges of the side layers and interlayer so formed are sewn together such as by a Merrow machine as described above to complete the construction of the cushion.

It is seen from the above that an outdoor cushion is provided whose filler material will normally remain dry even when the cushion is exposed to wet weather conditions and whose outwardly facing surfaces can be easily dried even after becoming wet. The cushion can be sufficiently dried to allow for its use immediately subsequent to the improvement of the wet weather conditions regardless of the manner in which the cushion is located on the furniture, i.e., whichever side faces upwardly. The particular construction of the cushion including the provision of the peripherally extending edge region thereof facilitates easy removal of water which flows by gravity from the side layers thereof and, additionally, constitutes an economic mode of construction.

Obviously, numerous modifications and variations of the present invention are possible in the light of the above teachings. For example, the side layers and interlayer need not be formed of the particular materials described above but may be formed of other suitable materials. The peripherally extending side edge regions of the respective side layers and interlayer need not be mutually attached in the manner specifically described above although the same is considered most advantageous. It is therefore to be understood that within the scope of the appended claims, the invention may be practiced otherwise than as specifically disclosed herein.

What is claimed is:

1. In a furniture cushion for outdoor use of the type including a pair of opposed side layers, each formed of woven fabric material, and attached to each other along their respective peripherally extending regions to define an interior space therebetween and a filler material located substantially throughout said interior space, the improvement comprising: said fabric material is formed of filaments at least the outer surfaces of which comprise thermoplastic material, a thin interlayer formed of water impervious plastic material having a peripherally extending edge region interposed between peripherally extending edge regions of said pair of opposed side layers, said peripherally extending edge regions of said side layers and interlayer being heat sealed to each other to form a continuous seal band extending around the entire periphery of the cushion, said interlayer extending entirely through said interior space to divide the latter into a pair of adjacent isolated chambers separated by said interlayer and wherein said filler material is located entirely in one of said chambers such that said interlayer is contiguous with the inner surface of one of said side layers and spaced from the inner surface of the other of said side layers by said filler material.

2. The combination of claim 1 wherein said filler material is polyurethane foam.

3. The combination of claim 1 wherein said filler material is polyester fiber batting.

4. The combination of claim 1 wherein said fabric material comprises filaments woven in a relatively loose weave and wherein each of said filaments comprise thread encapsulated in a thermoplastic material.

5. The combination of claim 4 wherein said thermoplastic material comprises vinyl.

6. The combination of claim 1 wherein said peripherally extending edge regions of said side layers and interlayer extend outwardly beyond said seal band so that said edge region comprises an inner seal band region and an outer region wherein said side layers and interlayer extend outwardly unsealed to each other and terminate at respective peripherally extending edges.

7. The combination of claim 6 wherein said peripherally extending edges of said side layers and interlayer are substantially coextensive and are sewn to each other to define a peripherally extending sewn cushion edge.

* * * * *